US006783026B2

(12) United States Patent
Chambers et al.

(10) Patent No.: US 6,783,026 B2
(45) Date of Patent: Aug. 31, 2004

(54) SYSTEMS AND METHODS PROVIDING BI-DIRECTIONAL PASSAGE OF AN OBJECT VIA AN ARTICULATED MEMBER

(75) Inventors: Richard G. Chambers, Portland, OR (US); Craig F. Robillard, Spencerport, NY (US); Barry G. Mannie, Portland, OR (US); Donald B. Maclane, Portland, OR (US)

(73) Assignee: Xerox Corporation, Stamford, CT (US)

( * ) Notice: Subject to any disclaimer, the term of this patent is extended or adjusted under 35 U.S.C. 154(b) by 80 days.

(21) Appl. No.: 10/248,389

(22) Filed: Jan. 15, 2003

(65) Prior Publication Data

US 2004/0135311 A1 Jul. 15, 2004

(51) Int. Cl.[7] ..... B65H 7/02
(52) U.S. Cl. ..... 221/265.01; 271/902
(58) Field of Search ..... 271/184, 265.01, 271/902; 162/263

(56) References Cited

U.S. PATENT DOCUMENTS 5,941,522 A * 8/1999 Hagstrom et al. ..... 271/225
6,651,980 B2 * 11/2003 Isemura et al. ..... 271/259
2001/0022422 A1 * 9/2001 Tamura ..... 271/10.03
2003/0062669 A1 * 4/2003 Yamakawa et al. ..... 271/176

FOREIGN PATENT DOCUMENTS

| | | | | |
|---|---|---|---|---|
| JP | 1-203138 | * | 8/1989 | ..... B65H/7/02 |
| JP | 7-234604 | * | 9/1995 | ..... B03G/15/20 |
| JP | 10-265092 | * | 10/1998 | ..... B65H/7/02 |
| JP | 11-334934 | * | 12/1999 | ..... B65H/7/02 |
| JP | 2003-312894 | * | 11/2003 | ..... B65H/7/02 |

* cited by examiner

*Primary Examiner*—Donald P. Walsh
*Assistant Examiner*—Kenneth W. Bower
(74) *Attorney, Agent, or Firm*—Oliff & Berridge, PLC

(57) ABSTRACT

An articulated flag body member permitting bi-directional passage of an object. The articulated flag body member has a flag body pivotably connected to a flag foot. As rotation of the flag foot occurs in one direction, the flag body rotates by engagement of a recess of the flag foot with a stop member extending along a projecting leg of the flag body. As the flag body rotates, a notch at the upper portion of the flag body changes positions such that light, or other signals, may no longer pass through the notch. Thus, positional indication of an object detected by rotation of the flag body. As rotation of the flag foot occurs in an opposite direction, an object may be extricated or removed.

9 Claims, 9 Drawing Sheets

SYSTEMS AND METHODS PROVIDING BI-DIRECTIONAL PASSAGE OF AN OBJECT VIA AN ARTICULATED MEMBER

BACKGROUND OF THE INVENTION

1. Field of Invention

This invention relates to systems and methods providing bi-directional passage of an object in a processing path by using an articulated member.

2. Description of Related Art

The sensor flags used in conventional sheet media handling devices may degrade system performance in several ways. The system performance may be degraded, for example by tearing the sheet of media, by breaking flags when attempting to remove a sheet of media from a processing path, by impairing image quality by reducing the uniform application of heat and/or pressure to the sheets of media, or by increasing the risk of interfering with other existing components of the sheet media handling device. Further, conventional designs commonly comprise unitary, single piece flags that require an increased slot size in the associated structures of the sheet media handling device, such as the pressure plate and/or heating plates of conventional copying, printing or document scanning devices. In such media handling devices, the increased slot size may either reduce the uniformity of heat and pressure distribution to a sheet of media as it travels in a processing path or provide a catch point for a sheet edge. In either case, image quality is reduced and/or system performance is reduced.

SUMMARY OF THE INVENTION

This invention provides an articulated knee joint flag permitting bi-directional travel of media in a processing path.

This invention separately provides systems and methods that allow media jammed in a processing path to be removed with minimal or no damage.

This invention separately provides an articulated knee joint flag having a pivotable flag body component and a pivotable flag foot component fixed to the pivotable flag body.

This invention separately provides a flag body having a u-shaped notch permitting passage of light for detection by an interrupt type sensor.

This invention separately provides an articulated knee joint flag having a pivotable flag body.

This invention separately provides a finger portion along one of the flag body and the flag foot, the finger portion corresponding to a recess in the other of the flag body and the flag foot.

This invention separately provides the finger portion as a spring affixed to one of the flag body and the flag foot.

In various exemplary embodiments, an articulated knee joint flag according to this invention has a flag body pivotably connected to a device and a flag foot pivotably connected to a flag body. As the flag body rotates, a notch at an upper portion of the flag body changes position such that light, or other signals, no longer passes through the notch. The flag foot engages the flag body due to an object traveling in a processing path in one direction, rotates the flag body and notch accordingly and indicates a position of the object. As the flag foot is also able to readily rotate in the opposite direction, the object is able to be removed from the processing path without damaging the flag and/or the object.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this Invention will be described in detail with reference to the following FIGS. 1–8, wherein like numerals represent like elements, and wherein.

DETAILED DESCRIPTION OF EXEMPLARY EMBODIMENTS

Figure 1:
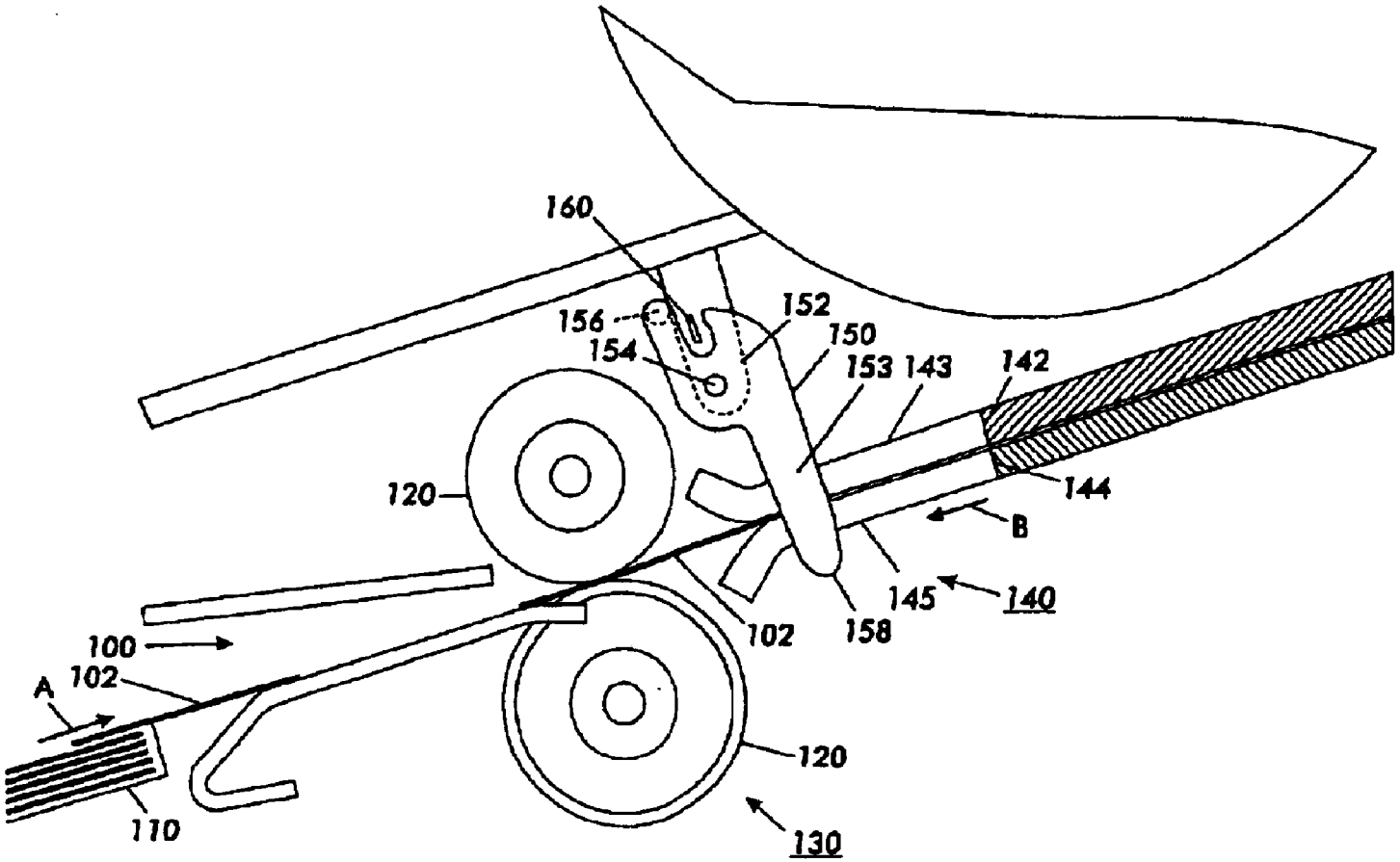
FIG. 1 shows a conventional single leg flag at rest.
Figure 2:
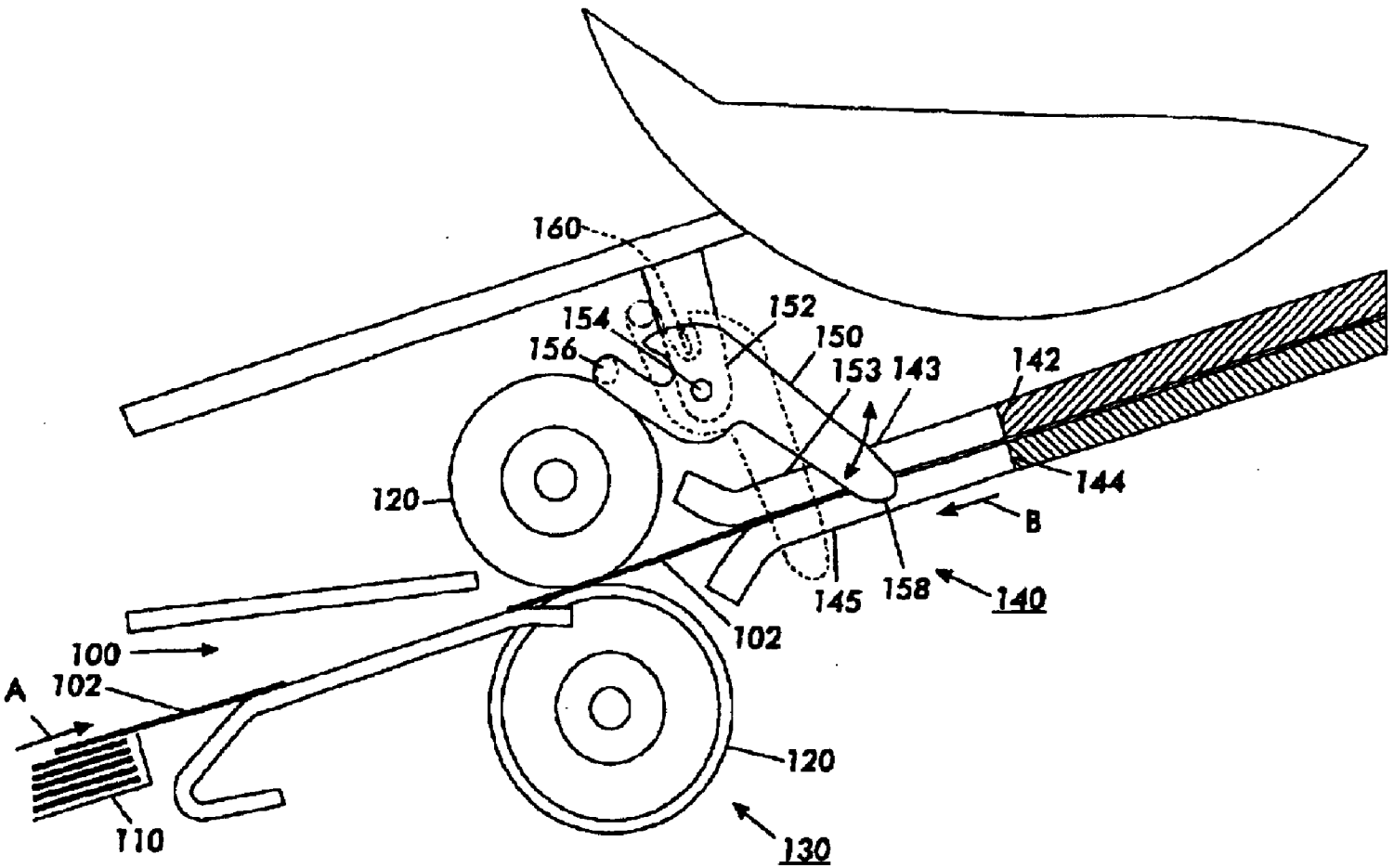
FIG. 2 shows the single leg flag of FIG. 1 as media proceeds in a direction of the processing path.
Figure 3:
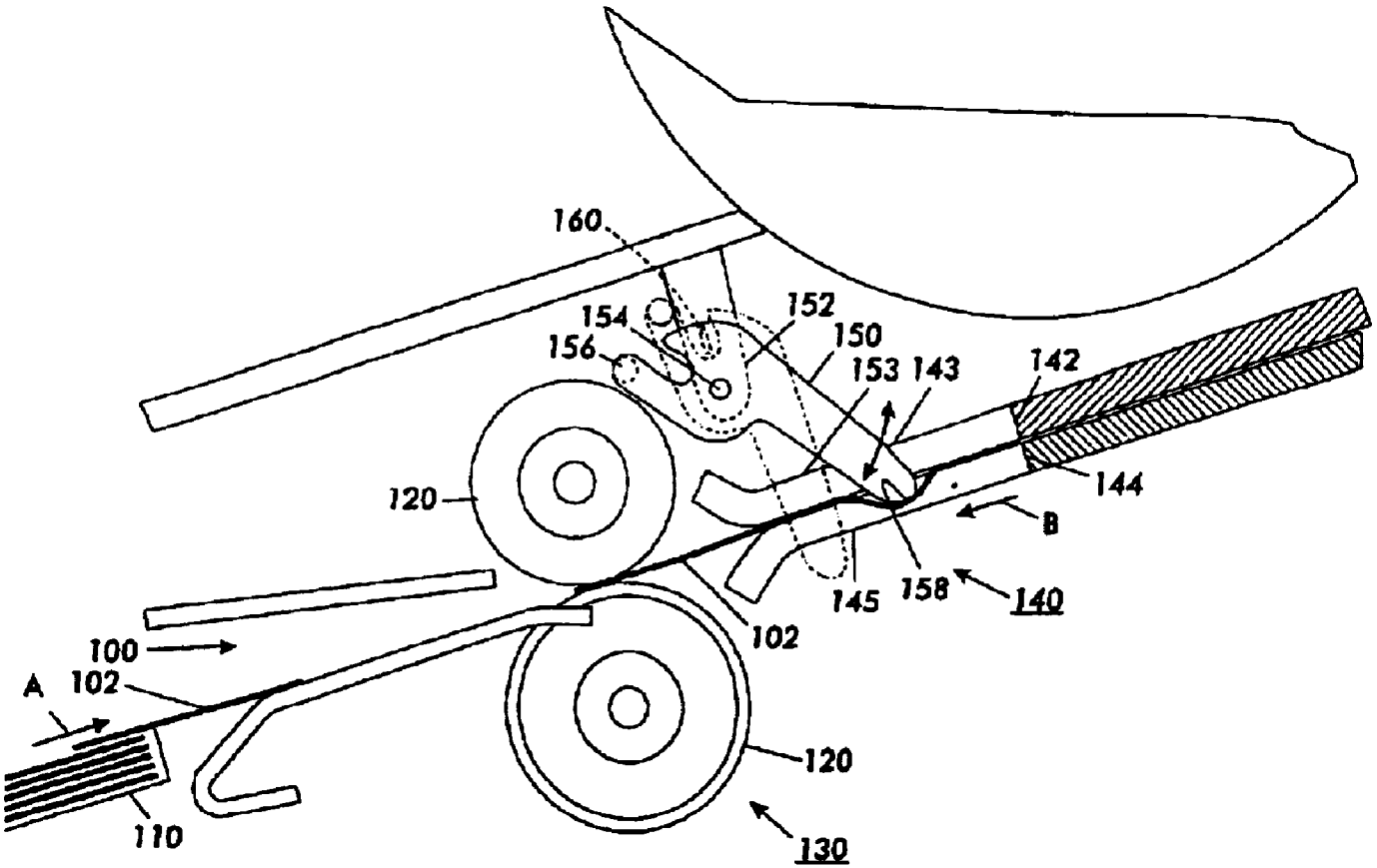
FIG. 3 shows the single leg flag of FIG. 1 as media proceeds in a direction reverse that of the processing path.

Conventional copying/scanning and/or printing devices provide a processing path 100 through which media travels to produce a final copied and/or printed product. FIGS. 1–3 show, for example, a typical copier and/or printer, in which a sheet of media 102 is provided from a paper tray 110 to a processing path 100 having an intended processing path 100 direction A. The sheet of media 102 is urged along the processing path 100 by driving rollers 120 that move the sheet of media 102 to a media heating stage 140. In the media heating stage 140, the sheet of media 102 travels through a pair of guiding plates to prepare the sheet of media 102 to evenly accept the image at the following stage. The sheet of media 102 then proceeds to subsequent processing stages or exits the copier and/or printer as a final product.

As the sheet of media 102 travels along the processing path 100 by the urging of the driving rollers 120, for example, a single leg flag 150 may be used to identify a position or location of the sheet of media 102 as the sheet of media 102 travels from one stage to another in the processing path 100. The single leg flag 150 is rotatable about a pin 154 formed in an upper portion 152 of the flag 150. A stop 156 is also provided at an end of the upper portion 152 of the flag 150. The stop 156 restricts rotation of the flag 150 in a direction B opposite the direction A of the processing path 100. Thus, when the stop 156 is engaged, the flag 150 is essentially at rest and no sheet of media 102 can be urged in the direction B of the processing path 100.

The single leg flag 150 also includes a tip 158 at an end of a lower portion 153 of the flag 150. The tip 158 protrudes into slots 143 and 145 respectively formed in each of the plates 142 and 144. The slots 143 and 145 in the two plates 142 and 144 must be large enough to accommodate the flag tip 158 as the flag 150 rotates due to travel of the sheet of media 102 along the processing path 100. However, the slots 143 and 145 should also be small enough that the required heating and pressing of the sheet of media 102 by the two plates 142 and 144 is uniformly achieved to, for example, accurately and consistently solidify an image onto the sheet of media 102. The pressure plate 142 and heating plate 144 are both relatively small. Each of the pressure plate 142 and the heating plate 144 is, for example, approximately three inches long, and lies in the direction of the processing path 100. Accordingly, the length of the slots 143 and 145 and the corresponding length of the single leg flag 150 are limited.

As shown more particularly in FIGS. 1 and 2, the single leg flag 150 operates In conjunction with a sensor 160 that indicates a location or position of the sheet of media 102 along the processing path 100 according to the rotational position of the flag 150. Such a sensor 160 may be, for example, an optical sensor that has its path of light broken or obstructed when the single leg flag 150 rotates as the sheet of media 102 proceeds in a direction A along the processing path 100.

Thus, when the flag 150 is at rest, the sensor 160 is fully exposed and light is readily transmitted to the sensor 160. However, as the sheet of media 102 travels along the processing path 100 and the flag 150 rotates, the path of light to the sensor 160 eventually becomes fully blocked by the rotation of the flag 150. As a result, the location or position of the sheet of media 102 along the processing path 100 may be determined. Once the sheet of media 102 has moved past the flag 150, the flag 150 reverts to its at-rest position by gravity, or, for example, in view of some other biasing force. Once the flag 150 has reverted to its at-rest position, the sensor 160 is again fully exposed. By determining the location or position of the sheet of media 102 in this manner, a processing stage may be Indicated as complete, and/or a subsequent processing stage may be authorized to begin.

As the sheet of media 102 travels along the processing path 100, however, media jams may occur. When a media jam occurs in the processing path 100, a full rotation of the single-leg flag 150 in the direction A of the processing path 100 may or may not be completely achieved. If the single leg flag 150 has been fully rotated when the jam occurs, then the sensor 160 is triggered and the downstream processing functions may have begun without the sheet of media 102 being available to receive the desired downstream processing. Thus, unnecessary use of the downstream printing and/or copying equipment may occur. If the single leg flag 150 has been only partially rotated and the sensor 150 has not yet been fully triggered, then the processing that was being performed at the time of the jam may continue to repeat itself, causing unnecessary wear and tear on the equipment and increasing the difficulty of clearing the jam. Typically, substantially all processing functions will be terminated until the jammed media is removed. Thus, when a media jam occurs, it becomes imperative that the jammed media be removed from the processing path to permit copying and/or printing to occur and to achieve the desired copied, scanned and/or printed final product.

To remove a media jam in such a conventional copying and/or printer device, an operator may have to pull the sheet of media 102 in the direction B which is opposite that of the Intended processing path 100 direction A. FIG. 3 shows, however, that removing a jammed sheet of media in this manner often results in tearing the sheet of media 102, as the tip 158 of the flag 150 forces the sheet of media 102 into the slot 145 of the lower plate 144. Further, the flag 1 So may also break due to pulling the sheet of media 102 against the flag 150, which resists rotation in the direction B once the flag 150 has returned to its rest position and engaged the stop 156. For example, the flags 150 are particularly prone to breakage when the flags 150 are made of plastic, as is common practice.

Tearing the sheet of media 102 results in higher copying and/or printing costs, as the torn sheet of media 102 must be replaced to obtain the final desired copy and/or print product. Such tearing also makes removing the sheet of media 102 more time consuming, as the torn sheet of media 102 must then be removed in a piecemeal fashion. Removing the jammed or torn sheet of media 102 also requires increased operator intervention, which likewise increases costs.

Similarly, breaking the flags 150 increase the operational costs of copying and/or printing, as replacement flags 150 must be used. Further, additional, and even more extensive, operator intervention Is required to replace damaged or broken flags 150.

Moreover, even if substantially all of the jammed sheet of media 102 is removed, often remnants of the jammed sheet of media 102 remain in the processing path 100 as a result of the sheet of media 102 catching on the flag 150 when the sheet of media 102 is pulled to remove the sheet of media 102 and eliminate the jam. Such media remnants pose problems when copying and/or printing is resumed, as the remnants may eventually displace and cause incomplete, blurred or otherwise defaced and undesirable copying and/or printing images in a subsequent copying and/or printing process.

Figure 4:
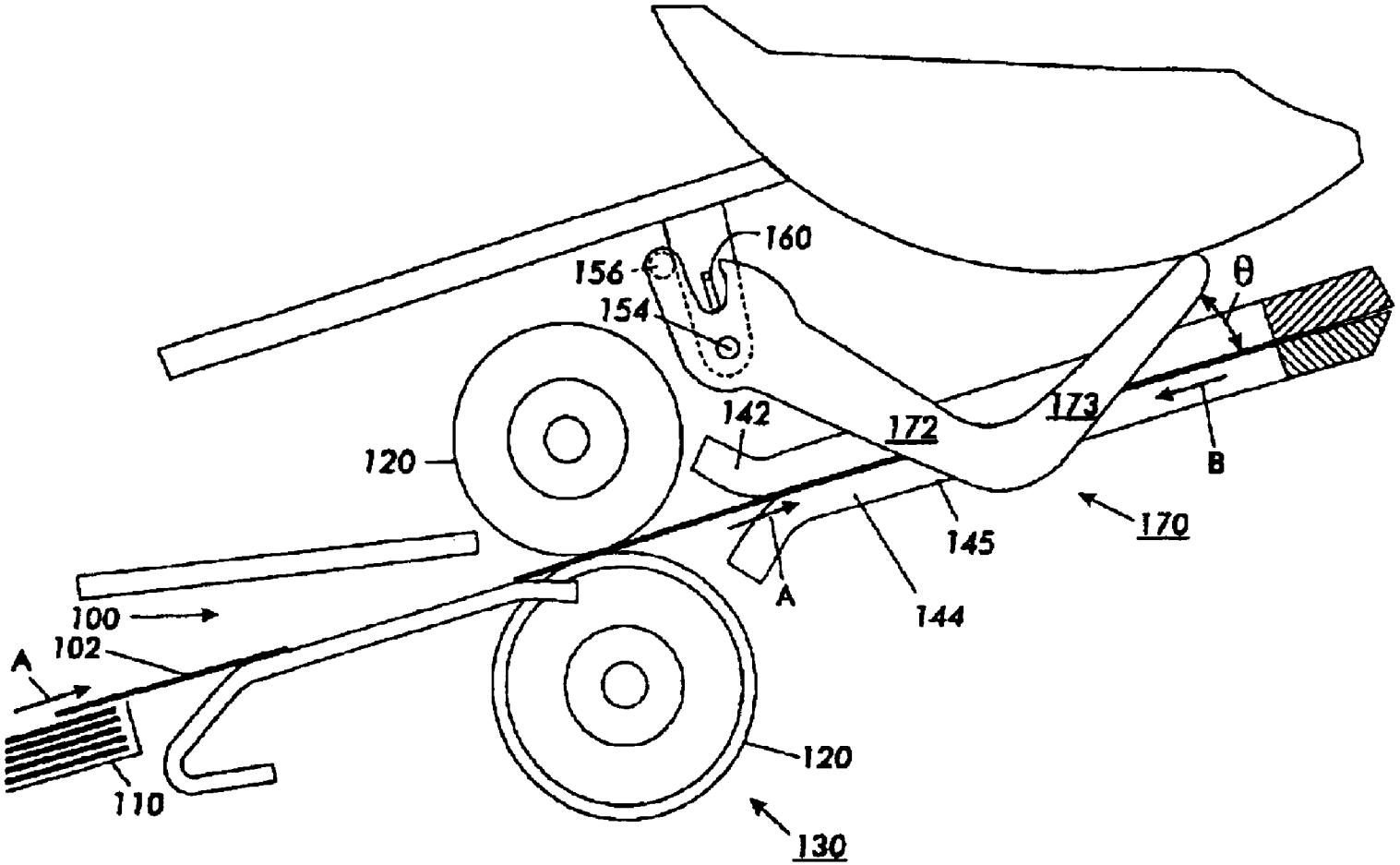
FIG. 4 shows a conventional boomerang-shaped two-legged flag in a processing path.

FIG. 4 shows a conventional copier and/or printing device that has attempted to resolve the problem of removing jammed media by using a longer, boomerang-shaped two-legged flag 170. The sheet of media 102 contacts one of two legs 172 and 173 of the boomerang-shaped two-legged flag 170, according to the direction the sheet of media 102 is traveling in along the processing path 100. As in the single leg flag 150 discussed above, the sheet of media 102 urges the flag 170 upwards to enable the sheet of media 102 to travel more freely in either the intended processing path direction A or the opposite processing path direction B. For example, the sheet media 102 strikes the leg 172 when proceeding in the direction A of the processing path 100. In contrast, the sheet of media 102 strikes the leg 173 when the sheet of media 102 is being pulled in the direction B, such as when the sheet of media 102 is being removed due to a media jam. Thus, the boomerang-shaped two-legged flag 170 permits bi-directional travel of the sheet of media 102 by allowing the sheet of media 102 to strike the flag 170 from either direction to lift the flag 170.

The boomerang-shaped two-legged flag 170 therefore reduces the likelihood that the sheet of media 102 will tear and minimizes breakage of the flags 170 because the sheet of media 102 is not pulled against the resistance of a flag stop, such as the stop 156 discussed above with respect to the conventional single leg flag 150. However, the length of this boomerang-shaped two-legged flag 170 is longer than that of the conventional single leg flag 150. The longer boomerang-shaped two-legged flag 170 therefore requires longer slots 143 and 145 in the pressure plate 142 and the heating plate 144, respectively.

For example, in an Ink-type printing system, as a result of the required longer slots 143 and 145, uniform heating of the sheet of media 102 by the heating plate 144 is difficult to achieve. As a further result of the required longer slots 143 and/or 145, the desired pressure on the sheet of media 102 by the pressure plate 142 is also difficult to achieve. Thus, uniformity of temperature is sacrificed with the boomerang-shaped two-legged flag design, resulting in undesirable image artifacts on the final print. Furthermore, the length of the boomerang-shaped two-legged flag 170 risks interfering with other components of the copier and/or printer, particularly when the flag 170 is fully lifted by the sheet of media 102, as should be appreciated from the situation shown in FIG. 4. It should be appreciated that other types of image forming systems experience negative effects as a result of the longer slots 143 and 145.

While the longer boomerang-shaped two-legged flag 170 reduces the chances of binding when the media is moved in the direction B, the longer boomerang-shaped two-legged flag 170 doesn't eliminate the chances of binding. The contacting surface of the leg 173 can become rough and/or the coefficient of friction between that surface and the sheet of media 102 can increase. This can occur, for example, because the surface of the leg 173 becomes sticky from contamination. In this situation, the boomerang-shaped two-legged flag 170 can move downwards in a locking manner similar to that shown in FIG. 3 with respect to the single leg flag 150. A further consequence of the long, gentle slope of the actuating surfaces 172 and 173 of the boomerang-shaped two-legged flag 170 is that the onset and drop-off points, that is, the points when the sensor 160 is either exposed or blocked, are less precise. This tends to limit the usefulness of this information in timing further print stages.

In various exemplary embodiments of the invention, as shown in FIGS. 5–9, an articulated knee joint flag 200 generally includes a flag body 210 having a notch 220 permitting passage of light from an LED 290 to a sensor 292. In various exemplary embodiments, the notch 220 is typically shaped as a "u", although other shapes may also be used. The notch 220 is formed at an upper portion 211 of the flag body and is bounded on one side by a functional edge 260 and on an opposite side by a projecting stop 250. The flag body 210 is pivotable about one or more first pins 212 that attach the flag body 210 to a frame or the like of a sheet media-handling device, such as, for example, a copier and/or a printer. The flag body 210 includes at least one projecting leg 230 substantially opposite the notch 220. Each projecting leg 230 ends in a tip 232. Each tip 232 is provided with a hole 234. One or more second pins 242 are inserted into the holes or recesses 234 to connect a flag foot 240 to the flag body 210 . A finger stop 270 is provided along, for example, a surface 236 of the projecting leg 230.

The flag foot 240 further comprises a recess 280 formed in an upper portion 241 of the flag foot 240. The flag foot 240 is pivotable about the second pin 242 that attaches the flag foot 240 to the flag body 210. The pivotable union and interaction of the projecting leg 230 of the flag body 210 with the flag foot 240 as the recess 280 engages and disengages the finger stop 270 represents the knee joint aspect of the articulated knee joint flag 200. For example, the recess 280 engages the stop 270 when the flag foot 240 rotates in one direction, for example the direction A of the processing path, and disengages the stop 270 when the flag foot 240 rotates in a direction opposite that of the processing path direction A.

The interaction of the stop 270 and the recess 280 between the flag body 210 and flag foot 240 of the articulated knee joint flag 200 effectively lock the knee joint when rotation of the articulated knee joint flag 200 occurs in one direction, for example, an intended processing direction A. In contrast, rotating the knee joint 200 in the opposite direction unlocks the knee joint 200 to permit the free rotation of of the flag foot 240 independently of the flag body 210.

The locking of the knee joint 200 by the interaction of the stop 270 and the recess 280 causes the flag body 210 and the flag foot 240 to rotate together in the same direction, as if the flag body 210 and flag foot 240 were a single unit, when the flag 200 rotates further in the intended processing path direction A. As a result, an upper portion 211 of the flag body 210 blocks the path of light, for example, to the sensor 292 as the functional edge 260 and upper portion 211 are rotated by the sheet of media 102 traveling in the processing path 100. Blocking the light from being received by the sensor 292 therefore indicates a position of the sheet of media 102 based on the rotational position of the flag body 210. If the flag 200 rotates in a direction reverse that of the intended processing path direction A, for example, then the knee joint flag 200 does not lock. The flag foot 240 thus pivots freely about the second pins 242 in the direction opposite the intended processing path direction A to allow jammed media, for example, to be removed.

Figure 6:
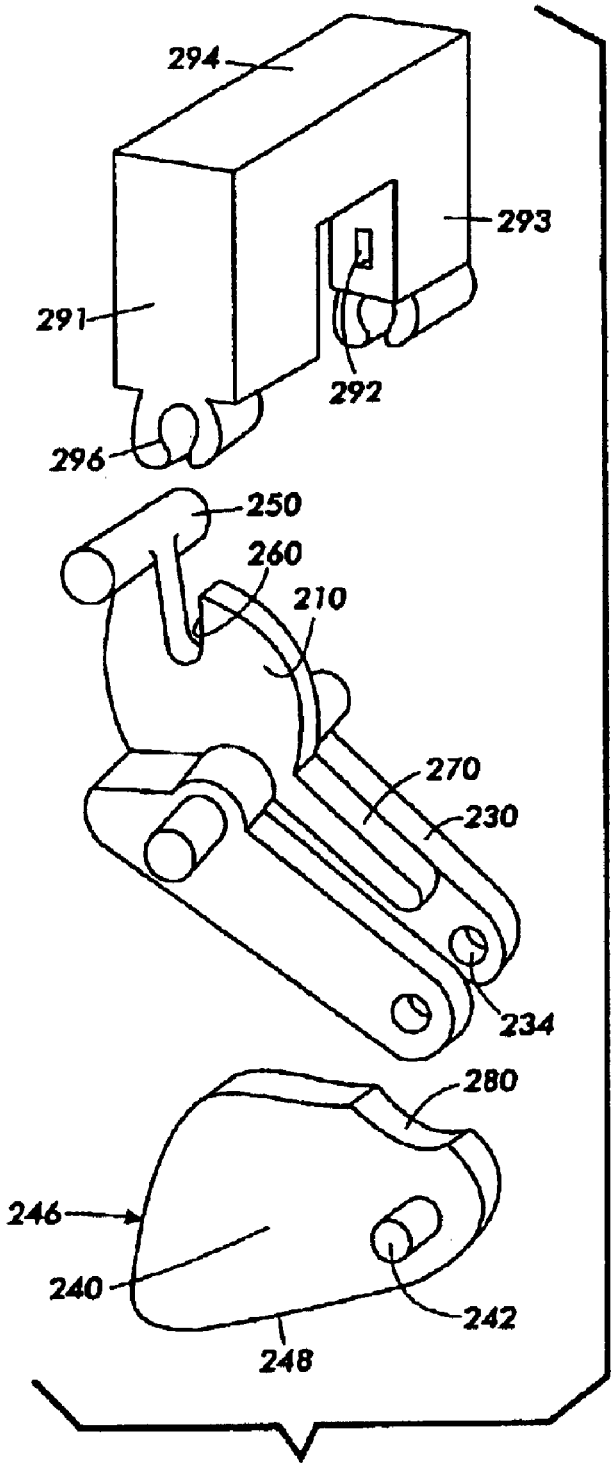
FIG. 6 shows an exploded perspective view of the exemplary embodiment of the articulated knee joint of FIG. 5.

FIG. 6 shows an exploded perspective view of one exemplary embodiment of the articulated knee joint flag 200. As shown in FIG. 6, the sensor 292 is provided in a sensor body 294 that contains the light emitting diode 290 in a first leg 291 and the sensor 292 in a second leg 293. The flag body 210 passes through a gap between the first and second legs 291 and 293. As shown in FIG. 6, in various exemplary embodiments, the pins 212 and 242 are each provided as a pair of pins integrally formed on, and extending away from, the flag body 210 and the flag foot 240, respectively. In particular, in this exemplary embodiment, as shown in FIG. 6, in an operative position, the pins 212 are placed into a pair of flag pivot structures 296. Likewise,in this exemplary embodiment, as shown in FIG. 6, the pins 242 extend from the flag foot 240 into the holes or recesses 234 formed in the projecting leg 230.

It should be appreciated that any other known or later-developed structure, device or apparatus can be used in place of the pivot structure 296 to hold the pins 212, such as a pair of recesses or holes formed in the first and second legs 291 and 293. Similarly, the holes or recesses 234 can be replaced with any appropriate known or later-developed pivot structure. Likewise, in various other exemplary embodiments, the one or more pin 212 can be a separate element that is held by the pivot structures 296 or the like. In this case, such a separate element would also pass through a hole in the flag body 210 provided in place of the pins 212. Similarly, the pins 242 can also be replaced with at least one separate element that fits into the recesses or holes 234. In this case, the flag foot 240 would also include a hole in place of the pins 242.

Figure 5:
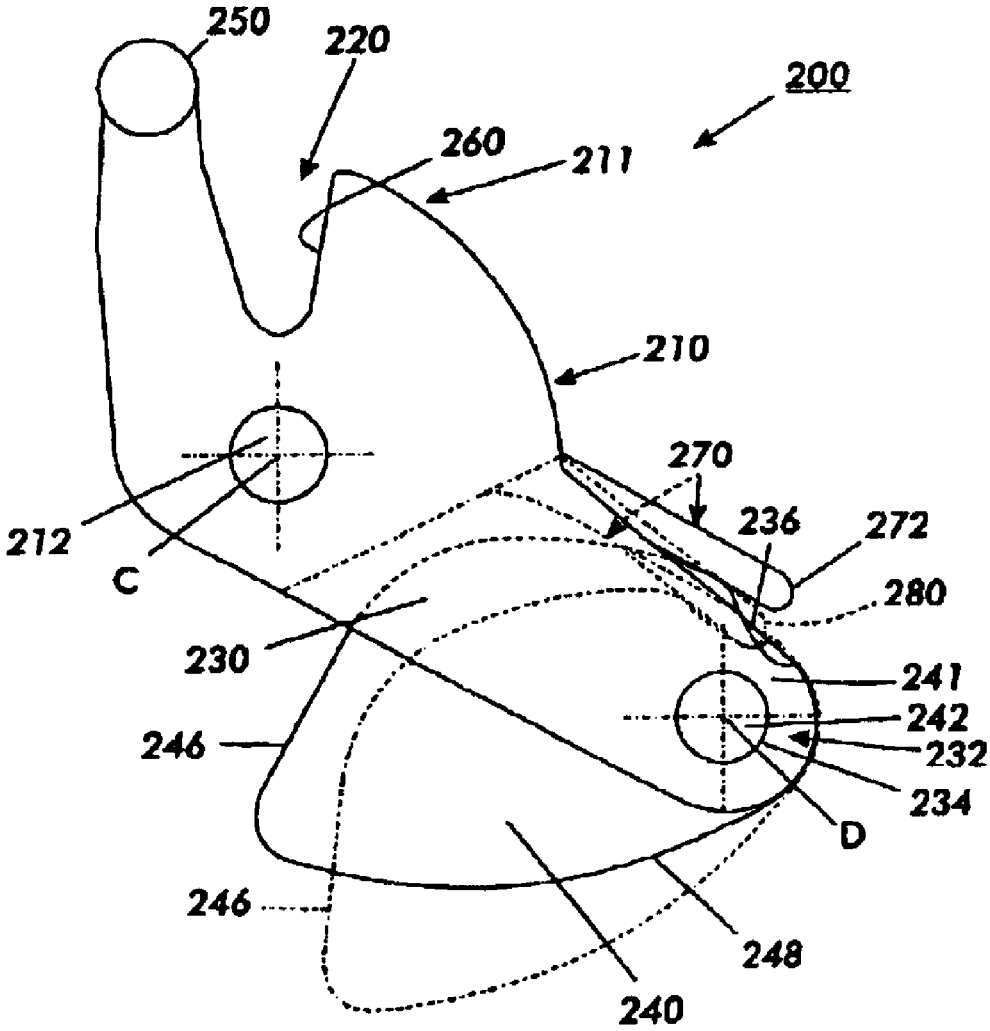
FIG. 5 shows one exemplary embodiment of an articulated knee joint flag according to this invention.

As shown in FIGS. 5 and 6, in various exemplary embodiments, the stop 270 extends between a pair of the projecting legs 230. In particular, as shown in FIG. 6, the stop 270 is not attached except at one end to the flag body 210 or the projecting legs 230. In this case, as shown in FIG. 5, when the flag foot 240 rotates the recess 280 away from the stop 270, the flag foot 240 biases the stop 270 away from its rest position. As a result, the stop 270 tends to apply a force on the flag foot 240 that tends to force the flag foot 240 in the opposite direction, i.e., to rotate the recess 280 toward the stop 270.

This force tends to return the flag foot 240 to its rest position after it has been forced from that rest position by the passage of a sheet of paper or the like along the processing path 100. In various other exemplary embodiments, this return force can be provided solely by gravity, assuming the copying/scanning and/or printing device is placed into the proper orientation. In various other exemplary embodiments, a spring or other force-generating member, device, apparatus or structure can be used to provide a return force to the flag foot 240.

As a result of the articulation of the flag foot 240 in the direction opposite that of the intended processing path direction A, media jams in the processing path 100 can be easily remedied by completely removing jammed sheets of media 102 from the processing path 100 without tearing the sheet of media 102. Additionally, flag breakage during removal of jammed media 102 is reduced due to the lower resistance of the lower pivoting component experiences as the sheet of media 102 is pulled in the direction B opposite that of the intended processing path direction A. Further, the knee joint flag 200 requires shorter slots 143 and 145 in the guiding plates 142 and 144, respectively, than the boomerang-shaped two-legged flag 170 discussed above. Thus, more uniform guiding pressure can be applied to sheets of the media 102 as the sheet of media 102 travels along the processing path 100. Accordingly, less waste, lower costs and greater image reproducibility can be obtained by using the articulated knee joint flag 200. Furthermore, the short length of the knee joint flag 200 provides a more abrupt drop-off point than does the boomerang-shaped two-legged flag 170. This abrupt drop-off allows more precise timing of that event for scheduling later processing steps.

FIG. 5 shows one exemplary embodiment of the articulated knee joint flag 200 according to the invention. Of course, it should be appreciated that the description of the exemplary embodiments of the articulated knee joint flag 200 set forth herein are directed to a knee joint flag 200 that is positioned after driving rollers 120 in a processing path 100 of a printer/copier. However, additional ones of the knee joint flag 200 may be positioned elsewhere along the processing path 100.

In the exemplary embodiment of the articulated knee joint flag 200 shown in FIGS. 5 and 6, the articulated knee joint flag 200 comprises at least the flag body 210 and the flag foot 240. The flag body 210 is pivotably connected to a separate element, such as, for example, a frame of a device in which the articulated knee joint flag 200 is being used, or, as shown in FIG. 6, the sensor body 294. The flag foot 240 is pivotably connected to the flag body 210. In various exemplary embodiments, such as that shown in FIG. 6, the flag body 210 is connected via a pivot joint or structure to the separate element. Likewise, in various exemplary embodiments, the flag foot 240 is connected through a pivot joint or structure to the flag body 210.

The flag body 210 is provided with the notch 220 at the upper portion 211 of the flag body 210. Light from the light emitting diode 290, for example, may pass through the notch 220 to the sensor 292 when the flag 200 is at a designated position, for example, at a rest position 202 as shown in FIG. 7.

One side surface of the notch 220 provides a functional edge 260 that blocks the light from the light emitting diode 290, for example, as the flag body 210 rotates. A second side surface of the notch 220, i.e., the side surface of the notch 220 opposite the functional edge 260, comprises a stop 250 at the uppermost portion of the flag body 210. The stop 250 prohibits the flag body 210 from rotating beyond a certain point, for example, the rest position 202 of the flag 200. As shown in FIGS. 5 and 6, the pins 212 are provided on the flag body 210, approximately below the notch 220, to secure the flag body 210 to the separate element.

One or more lower portion projecting legs 230 of the flag body 210 extend approximately from the pins 212 of the flag body 210 to a tip 232 at an end of the projecting leg 230 of the flag body 210. The projecting leg 230 is provided with one or more holes or recesses 234 that receive the one or more pins 242 connecting the flag foot 240 to the flag body 210. The flag body 210 thus pivots about a first pivot axis C provided by the one or more pins 212 that secure the flag body 210 to the separate element. The flag foot 240, on the other hand, pivots about a second pivot axis D provided by the one or more pivot pins 242 extending into the second holes or recesses 234 to secure the flag foot 240 to the flag body 210.

Figure 7:
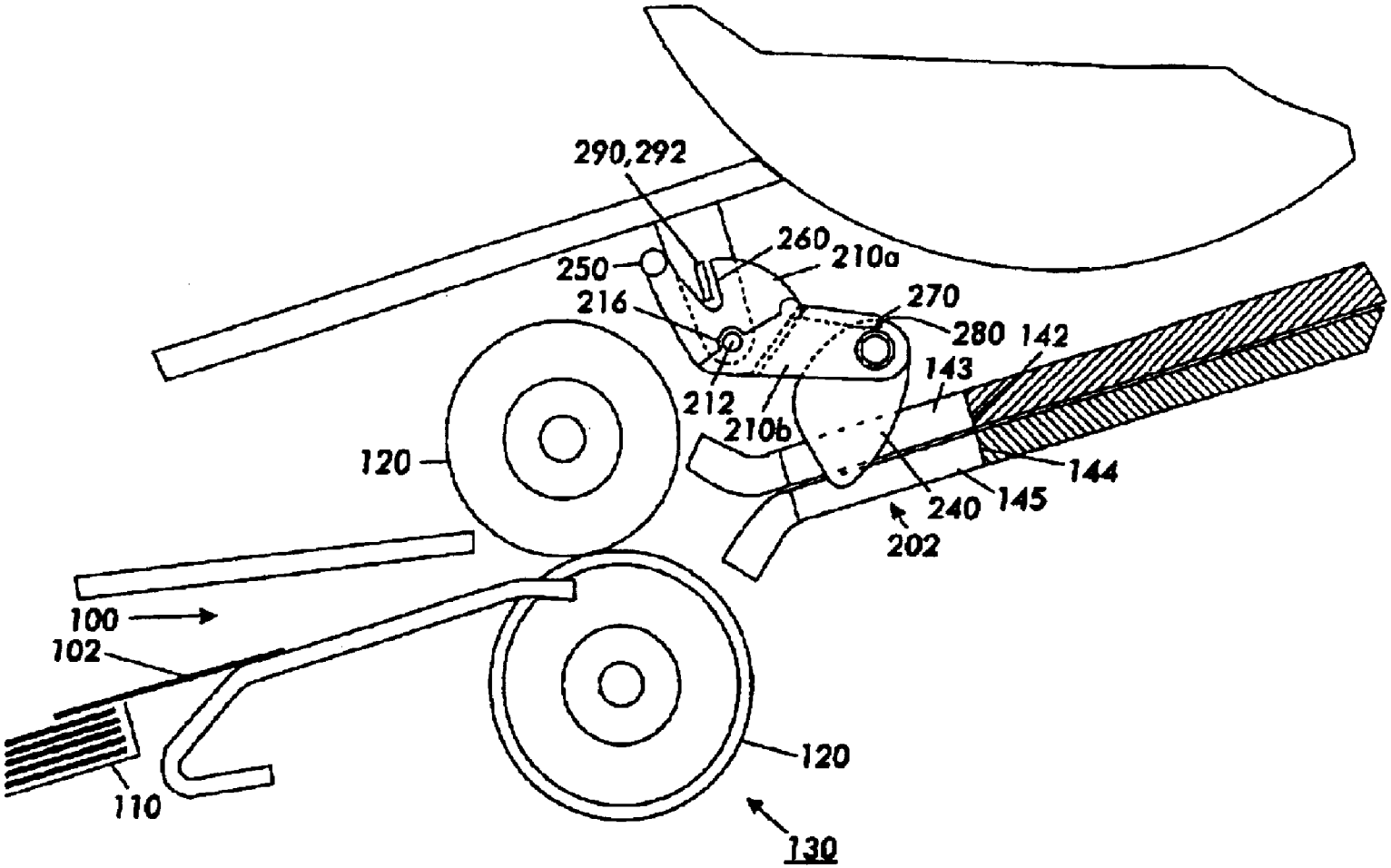
FIG. 7 shows the exemplary embodiment of the articulated knee joint of FIG. 5 at rest in a processing path of a copier/printer.

It should be appreciated that, while the flag body 210 is described in this exemplary embodiment as a substantially unitary element, the flag body 210 may also be formed using more than one segment as shown In FIG. 7, provided that all of the segments are unified in some manner so that all segments of the flag body 210 are capable of pivoting in unison when the articulated knee joint flag 200 is rotated about the first pivot axis C. For example, the upper portion 211 of the flag body 210 may be a first segment 210*a*, and the projecting leg 230 of the flag body 210 may be a second segment 210*b*. The first and second segments 210*a* and 210*b* may thus be fixed to one another and similarly pivotable about the first pivot axis C using the same one or more pivot pins 212 provided on each of the segments 210*a* and 210*b* to render the entire flag body 210 pivotable, as in the exemplary embodiment described above.

The flag body 210, when implemented using the segments 210*a* and 210*b*, would still include a finger stop 270 that extends along an upper surface 236 of the projecting leg 230 formed as the segment 210*b* of the flag body 210. An end 272 of the finger stop 270 is provided a distance from the tip 232 of the projecting leg 230 of the flag body 210. The end 272 of the finger stop 270 corresponds to a recess 280 provided in the flag foot 240.

It should be appreciated that, although the finger stop 270 is described as integral with the flag body 210, the finger stop 270 may also be separately secured to the flag body 210. For example, the finger stop 270 could instead be a spring finger secured to the flag body 210 and extending along the upper surface 236 of the flag body 210. An end of the spring finger would thus similarly correspond with the recess 280 in the flag foot 240. It should be further appreciated that the finger stop 270 on the projecting leg 230 of the flag body 210 may be positioned at different locations on the projecting leg 230 provided the recess 280 of the flag foot is correspondingly located to engage and disengage the finger stop 270 as the knee joint action of the flag body 210 and the flag foot 240 occurs.

The flag foot 240 of the articulated knee joint flag 200 extends into the processing path 100. As a sheet of media 102 travels along the processing path 100, the sheet of media 102 strikes either a first face 246 or a second face 248 of the flag foot 240. The first face 246 or the second face 248 of the flag foot 240 that is struck by the sheet of media 102 depends on which direction the sheet of media 102 is traveling.

FIG. 7 shows one exemplary embodiment of the articulated knee joint flag 200 at the rest position 202. The knee joint flag 200 is located downstream of the drive rollers 120 and similarly situated relative to the pressure plate 142 and the heated plate 144 as the conventional single leg flag 150 or the two-legged flag 170 discussed above. The flag foot 240 protrudes through the slots 143 and 145 as did the single leg flag 150 and the two-legged flag 170. However, because the flag foot 240 of the articulated knee joint flag 200 is not as long as the two-legged flag 170, the length of the slots 143 and 145 corresponding to the flag foot 240 of the knee joint flag 200 is much smaller. Accordingly, more uniform pressure and/or heat can be applied to the sheet of media 102 as the sheet of media 102 travels between the pressure plate 142 and the heated plate 144. As a result, better image reproducibility is possible.

Figure 8:
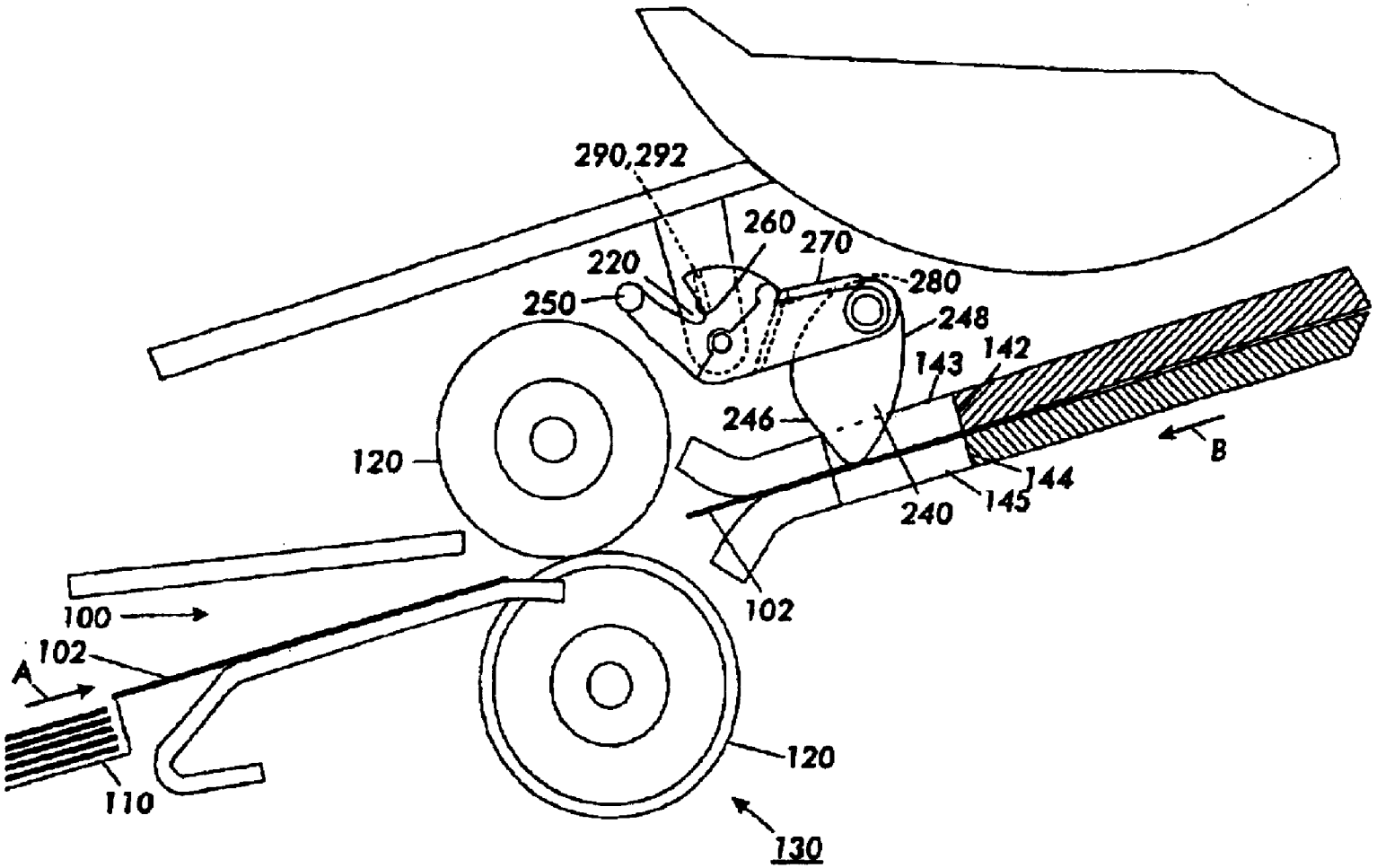
FIG. 8 shows the exemplary embodiment of the articulated knee joint of FIG. 5 as media is moved in the intended processing direction.

FIG. 8 shows the action of the knee joint flag 200 as a sheet of media 102 travels along the processing path 100 in an intended processing path direction A. The sheet of media 102 is fed from the paper tray 110, through the drive rollers 120, for example, and then strikes the first face 246 of the flag foot 240 with a leading edge of the sheet of media 102. The recess 280 of the flag foot 240 engages the finger stop 270 of the flag body 210 and locks together the flag foot 240 and flag body 210. As the sheet of media 102 travels further along the intended processing path direction A, the sheet of media 102 urges the flag body 210 and the flag foot 240 to operate in tandem and rotate as if the flag body 210 and the flag foot 240 were a single, unitary element. That is, the flag foot 240 and the flag body 210 rotate as one.

As the flag foot 240 and the flag body 210 rotate, the functional edge 260 of the notch 220 in the flag body 210 blocks the path of light from the light emitting diode 290. Thus, the light from the light emitting diode 290 does not reach the sensor 292. As the knee joint flag 210 continues to rotate due to the sheet of media 102 continuing to travel in the intended processing path direction A, the upper portion 211 of the flag body 210 eventually entirely blocks the path of light from the light emitting diode 290. As a result, as illustrated in FIG. 8, the sensor 292 indicates that light is no longer being detected. Therefore, the flag body 210 has been rotated, which indicates that the sheet of media 102 is traveling between the upper guiding plate 142 and the lower guiding plate 144. The path of light to the sensor 292 remains blocked until a trailing edge of the sheet of media 102 has entirely passed the flag foot 240.

Once the trailing edge of the sheet of media 102 has passed the flag foot 240, the flag foot 240 and the flag body 210 return to their original rest position 202 as a result of gravity, or in view of some other biasing structure, such as, for example, a spring, or as shown in FIG. 5, the finger stop 270. As shown in FIG. 7, once the knee joint flag 200 has returned to its rest position 202, the notch 220 is again repositioned to permit light to pass through and be detected by the sensor 292.

The position of the sheet of media 102 is determined according to the ability of the sensor 292 to detect light from the LED 290 passing through the notch 220 of the flag body 210. Likewise, the timing and sequencing of other processing functions may be determined by detecting the location or position of the sheet of media 102 as determined by the corresponding position of the flag body 210.

Should a media jam, or other circumstance, occur requiring that the sheet of media 102 travel in the direction B opposite the Intended processing path A, the flag foot 240 is then either struck on the face 248 or at least rotated in the direction B opposite that of the Intended processing path direction A. By rotating the flag foot 240 in the direction B, the recess 280 of the flag foot 240 is rotated away from engagement with the finger stop 270 of the flag body 210. The flag foot 240 is therefore free to rotate in the direction B such that sheets of media jammed or otherwise trapped under the flag foot 240 may be easily removed, while the flag body 210 of the knee joint flag 200 can remain substantially stationary.

Figure 9:
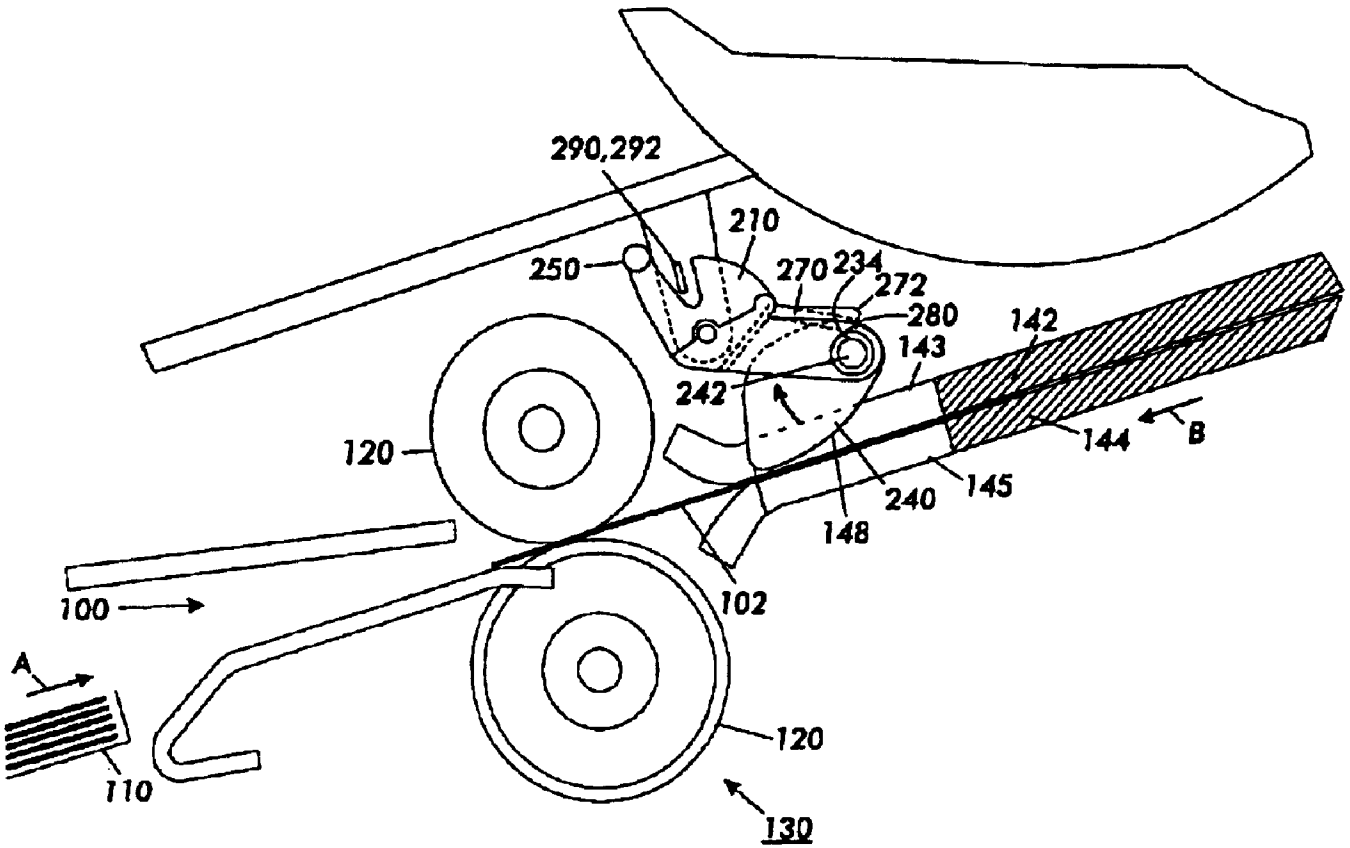
FIG. 9 shows the articulated knee joint flag of FIG. 5 as a sheet of media is being pulled in a direction reverse that of the intended processing direction.

FIG. 9 shows an example of pulling on a sheet of media 102 when a jam has occurred. In this instance, for example, the sheet of media 102 is pulled in the direction B opposite the intended direction A. As a result, the recess 280 of the flag foot 240 disengages from the finger stop 270 of the flag body 210. The flag body 210, however, remains substantially stationary, or merely returns to the at-rest position 202. As a result of the flag foot 240 rotating in direction B, the media is easily removed from the jammed location and the flag body 210, the flag foot 240 articulated knee joint flag 200 in general remains intact. Accordingly, the frequency of replacing the flag 200 is reduced, as the sheet of media 102 is easily removable. Further, the sheet of media 102 may be removed without tearing because of the flexibility of the flag foot 240 of the articulated knee joint flag 200. If the surface 248 should become roughened or sticky, as described above in the case of the boomerang-shaped two-legged flag 170, the flag foot 240 would still be able to be lifted away from the media 102, allowing the flag foot 240 to be cleared from the paper path.

It should be appreciated that the operation of the flag disclosed above allows the printer to self-test to determine that the LED is functioning when the printer is idle and no paper is present in the media path. It should be appreciated that ir is possible to reverse the flag operation, such that light is normally blocked by the flag when it is at rest, and normally unblocked by the flag when the flag is operated. The invention described herein is exemplary only. It should be appreciated that the various embodiments described herein are not intended to be limiting. Rather, various alternatives are readily within the scope of one reasonably skilled in the art, and all those alternatives embodiments are expressly intended and understood as being within the scope and breadth of the invention otherwise described herein.

What is claimed is:

1. An articulated flag member, comprising:

a flag body having an upper portion and a lower projecting leg, the flag body pivotably connected to a device;

a notch at the upper portion of the flag body through which signals may pass;

a stop member extending along the projecting leg of the flag body toward a tip end of the projecting leg;

a flag foot pivotably connected to the flag body, the flag foot having a first surface and a second surface, each surface facing in an opposite direction of one another, such that an object striking the first surface rotates the flag foot in a first direction, whereas the object striking the second surface rotates the flag foot in a second direction, the second direction opposite the first direction; and a recess in the flag foot, the recess engaging or disengaging the stop member according to rotation of the flag foot.

2. The articulated flag member of claim 1, wherein the notch further comprises:

a flag body stop on one side of the notch; and a functional edge on an opposite side of the notch, the notch provided between the flag body stop and the functional edge.

3. The articulated flag member of claim 1, wherein the flag body is pivotably connected to the device by a first connection structure.

4. The articulated flag member of claim 3, wherein:

the first connection structure comprises a pair of pins formed on and extending from the upper portion of the flag body between a lower portion of the notch and the projecting leg; and the pair of pins are engable with a pivot structure formed on the device to pivotably connect the flag body to the device.

5. The articulated flag member of claim 1, wherein the stop member is integral with the projecting leg of the flag body.

6. The articulated flag member of claim 1, wherein the stop member is separable from the projecting leg of the flag body.

7. The articulated flag member of claim 1, wherein the recess formed on an upper surface of the flag foot, the recess corresponding to an end of the stop member of the projecting leg of the flag body.

8. A method for allowing bi-directionally passage of an object in a processing path using an articulated flag member, the articulated flag member comprising:

a flag body having an upper portion and a lower projecting leg portion, the flag body having a notch at the upper portion, the flag body being pivotably connected to a device, the lower projecting leg having a stop member extending toward a tip end of the projecting leg; and a flag foot pivotably connected to the flag body, the flag foot having a first surface, a second surface opposite the first surface, and a recess, the recess corresponding to an end of the stop member, the method comprising:

passing a signal through the notch, passage of the signal indicating one of an at-rest position of the articulated flag member and an operated position of the articulated flag member;

contacting the first surface of the flag foot with an object that is traveling in a processing path in the first direction, causing the flag foot to rotate;

engaging the recess with the stop member in response to rotation of the flag foot in the first direction to lock the flag foot and flag body;

rotating the locked flag foot and flag body further in the first direction in response to the object continuing to travel in the first direction, causing the functional edge and upper portion of the flag body to one of obstruct passage of signals through the notch and permit passage of signals through the notch; and returning the articulated flag body member to the at-rest position once the object has passed beyond the flag foot in the first direction.

9. The method of claim 8, wherein the method further comprises:

contacting the second surface of the flag foot with an object that is traveling in the processing path in a second direction, causing the flag foot to rotate in the second direction;

disengaging the recess from the stop member in response to rotation of the flag foot in the second direction to unlock the flag foot and flag body; rotating the flag foot further in the second direction in response to the object moving in the second direction; and returning the flag foot to the rest position once the object has traveled in the second direction past the flag foot.

* * * * *